US005615659A

United States Patent [19]

Morita et al.

[11] Patent Number: 5,615,659

[45] Date of Patent: Apr. 1, 1997

[54] IGNITION APPARATUS FOR INTERNAL COMBUSTION ENGINE

[75] Inventors: Shingo Morita; Mitsuru Koiwa, both of Tokyo, Japan

[73] Assignee: Mitsubishi Denki Kabushiki Kaisha, Tokyo, Japan

[21] Appl. No.: 625,115

[22] Filed: Apr. 1, 1996

[30] Foreign Application Priority Data

Apr. 24, 1995 [JP] Japan ..... 7-098812

[51] Int. Cl.[6] ..... F02P 11/00

[52] U.S. Cl. ..... 123/634; 123/633

[58] Field of Search ..... 123/634, 633, 123/635, 647; 336/178, 165, 198, 107, 197, 96; 29/606; 364/431.12

[56] References Cited

U.S. PATENT DOCUMENTS

| | | | |
|---|---|---|---|
| 4,384,331 | 5/1983 | Fukuhara et al. | 364/431.12 |
| 4,527,535 | 7/1985 | Ito et al. | 123/617 |
| 4,691,667 | 9/1987 | Eberhardt et al. | 123/633 |
| 5,003,959 | 4/1991 | Umezaki et al. | 123/647 |
| 5,271,373 | 12/1993 | Takaishi et al. | 123/634 |
| 5,285,760 | 2/1994 | Takaishi et al. | 123/634 |
| 5,313,927 | 5/1994 | Takaishi | 123/634 |
| 5,359,982 | 11/1994 | Taruya | 123/634 |
| 5,437,259 | 8/1995 | Hamada et al. | 123/630 |
| 5,485,825 | 1/1996 | Shimizu et al. | 123/634 |
| 5,550,704 | 8/1996 | Morita et al. | 361/263 |

*Primary Examiner*—Raymond A. Nelli

*Attorney, Agent, or Firm*—Sughrue, Mion, Zinn, Macpeak & Seas

[57] ABSTRACT

Disclosed is an ignition apparatus for an internal combustion engine including a power switch 20 for intermittently feeding a primary current to an ignition coil, a primary coil 5 and a secondary coil 6 of the ignition coil being contained in an insulation case 1 with the power switch 20, primary coil 5 and secondary coil 6 being fixed by an insulating resin material 15 poured into the insulation case 1, the ignition apparatus comprising a shield plate 23 interposed between the secondary coil 6 and the power switch 20 to shield the power switch 20 from electromagnetic waves. With this arrangement, there can be obtained an ignition apparatus for an internal combustion engine by which the malfunction of the power switch and the like caused by electromagnetic waves generated at the ignition coil can be prevented.

4 Claims, 5 Drawing Sheets

IGNITION APPARATUS FOR INTERNAL COMBUSTION ENGINE

BACKGROUND OF THE INVENTION

1. Field of the Invention

The present invention relates to an ignition apparatus for an internal combustion engine arranged such that a power switch for intermittently feeding a primary current to an ignition coil and a primary coil and a secondary coil of the ignition coil are contained in an insulation case, and the power switch, the primary coil and the secondary coil are fixed by an insulating resin material poured into the insulation case.

2. Description of the Related Art

FIG. 5 is an overall perspective view of a conventional ignition apparatus for internal combustion engine disclosed in Japanese Utility Model Laid-Open No. 4-77220, FIG. 6 is a longitudinal cross sectional view of FIG. 5, FIG. 7 is a perspective view of an insulation case of FIG. 5 and FIG. 8 is a an electric circuit diagram of the ignition apparatus for internal combustion engine. In the drawings, a hole 1*b* is defined to the bottom of the accommodating unit 1*a* of a synthetic resin insulation case 1 at the center thereof. The central portion of a first E-shaped iron core 2 of an ignition coil passes through the hole 1*b*. A second E-shaped iron core 3 of the ignition coil is spaced apart from the first E-shaped iron core 2-in confrontation therewith. A primary coil 5 is wound through a bobbin 4 around the central portion of the first E-shaped iron core 2 and the central portion of the second E-shaped iron core 3 spaced apart from the first E-shaped iron core 2 in confrontation therewith. The ignition coil has a secondary coil 6 wound around the outer periphery of the primary coil 5 thereof.

A power switch 7 is accommodated in an auxiliary accommodating section 1*c* projecting from the accommodating section 1*a*. The power switch 7 includes a tray-shaped copper heat sink 8, a power transistor 9 accommodated in the heat sink 8, a hybrid integrated circuit (hybrid IC) 10 for driving and controlling the power transistor 9, a silicone gel 11 filled into the heat sink 8 for protecting the power transistor 9 and the hybrid integrated circuit 10 and a rid 12 for sealing the interior of the heat sink 8.

The insulation case 1 includes a holding section 1*d* for a high-tension terminal 13 as a high-tension portion of the ignition coil and a holding section 1*e* for a low-tension terminal unit 14. The low-tension terminal unit 14 includes a VB terminal 14*a* (FIG. 8) for connecting the primary coil 5 to the battery of an automobile, an ignition signal input terminal 14*b* (FIG. 8) for imposing an ignition signal from a control unit (not shown) to the power switch 7 and a ground terminal 14*c*. Note, the accommodating section 1*a* and auxiliary accommodating section 1*c* of the insulation case 1 are filled with an insulating resin material 15 composed of a cured epoxy resin.

In the ignition apparatus for the internal combustion engine arranged as described above, a primary current flowing to the primary coil 5 of the ignition coil is controlled through the power switch 7 in response to an ignition signal which is input from the ignition signal input terminal 14*b* through the control unit. A high-tension voltage is generated to the secondary coil 6 of the ignition coil in accordance with the primary current flowing to the primary coil 5.

In this example, the heat sink 8 is used to secure the heat radiation property of the power switch 7 so as to uniformly diffuse heat from the powerswitch 7 to the overall heat sink 8 and discharge the heat to the outside air through the insulating resin material 15 and the insulation case 1.

Since the power transistor 9 has a collector directly attached to the heat sink 8 in the conventional ignition apparatus for the internal combustion engine, there is a problem that high-tension voltage generated at the secondary coil 6 induces a voltage at the heat sink 8 and the power transistor 9 causes malfunction. Further, there is also a problem that due to a high-tension voltage induced to the heat sink 8, noise is superposed on an ignition signal in an ignition signal input line through a capacitance C between the collector and the base of the power transistor 9, thereby causing malfunctions of other equipment.

SUMMARY OF THE INVENTION

An object of the present invention made to solve the above problems is to provide an ignition apparatus for an internal combustion engine capable of preventing the malfunction of a power switch and the like caused by electromagnetic waves generated at an ignition coil.

Accordingly, an ignition apparatus for an internal combustion engine of the present invention comprises: an ignition coil; a power switch for supplying a primary current to said ignition coil; an electrically insulating case containing said ignition coil and said power switch therein; an electromagnetic shield disposed between said ignition coil and said power switch for protecting said power switch from electromagnetic waves generated at the ignition coil; and an electrically insulating resin disposed within said case for securely holding said ignition coil, said power switch, and said shield within said case.

DESCRIPTION OF PREFERRED EMBODIMENTS

Embodiment 1

Figure 1:
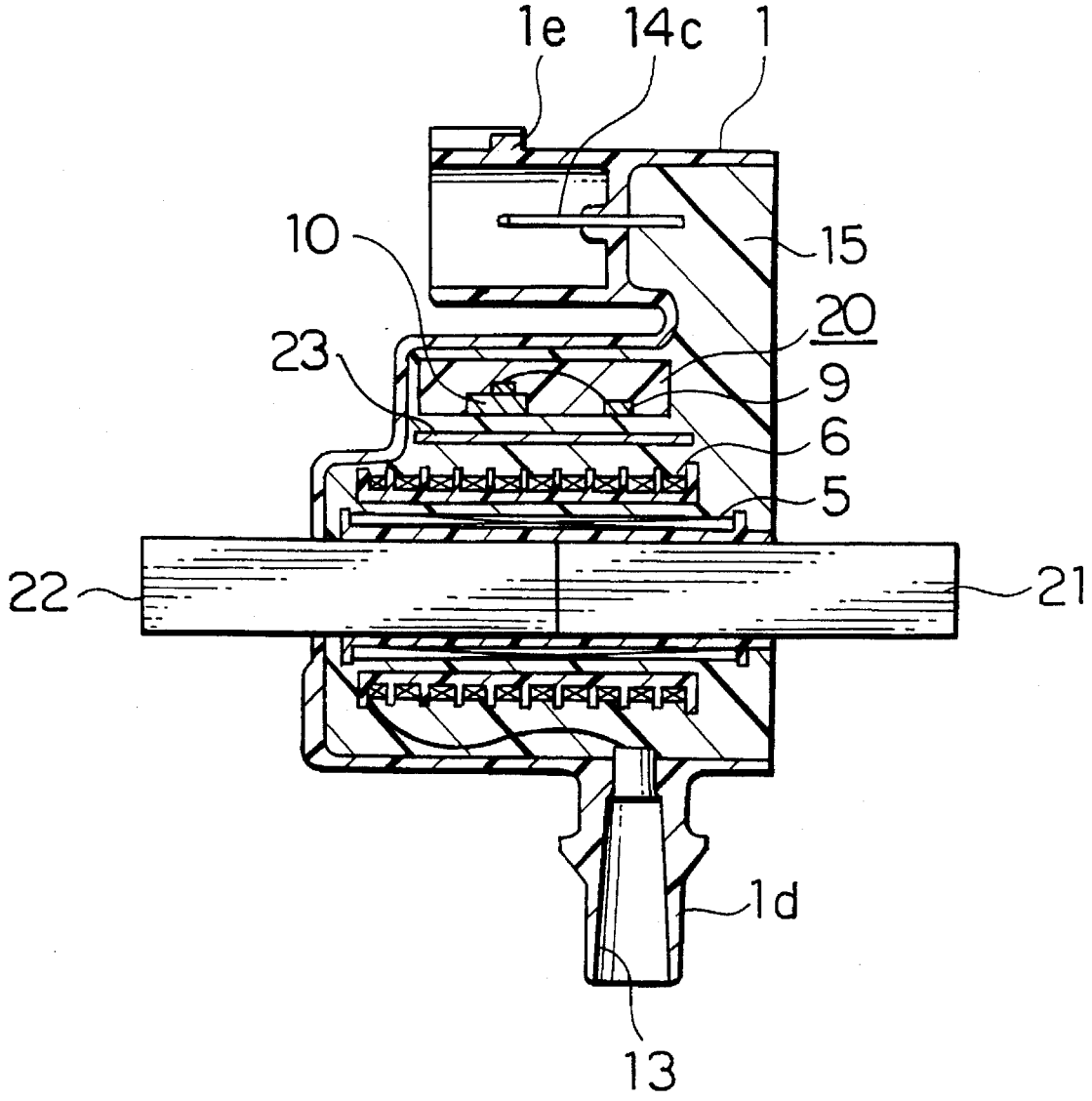
FIG. 1 is a sectional front view showing an embodiment of an ignition apparatus for an internal combustion engine according to the present invention.
Figure 2:
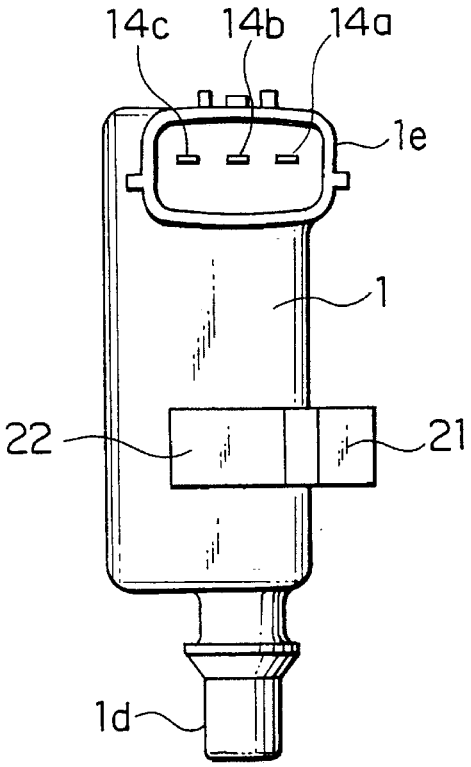
FIG. 2 is a left side elevational view of FIG. 1.

FIG. 1 is a sectional front view showing an embodiment or an embodiment 1 of an ignition apparatus for internal combustion engine according to the present invention and FIG. 2 is a left side elevational view of FIG. 1, wherein the same numerals as used in FIG. 5 to FIG. 8 are used to denote the same or corresponding parts and the description thereof will be omitted.

In the embodiment 1, a power switch 20 is composed of a power transistor 9 and a hybrid integrated circuit (hybrid IC) 10 for driving and controlling the power transistor 9 which are sealed by a resin as solid members by insert molding. A primary coil 5 and a secondary coil 6 are wound around an iron core composed of a first C-shaped iron core 21 and a second C-shaped iron core 22. A copper shield plate 23 as a shield member for shielding electromagnetic waves is interposed between a power switch 20 and the secondary coil 6. The flat-plate-shaped shield plate 23 is electrically connected to a ground terminal 14*c*.

In the ignition apparatus for an internal combustion engine, electromagnetic waves caused by high-tension voltage generated at the secondary coil 6 as the high-tension unit of an ignition coil are discharged toward the outside and a part of the electromagnetic waves are discharged toward the power switch 20. However, the electromagnetic waves to the power switch 20 are shielded by the shield plate 23 and do not affect the power switch 20. Therefore, the malfunction of the power switch 20 is not caused by the effect of the electromagnetic waves and the malfunction of other equipment is not caused by noise which is superposed on an ignition signal line.

Further, electromagnetic waves generated at the high-tension terminal 13 as the high-tension unit and discharged toward the power switch 20 are also shielded by the shield plate 23 and do not affect the power switch 20.

Embodiment 2

Figure 3:
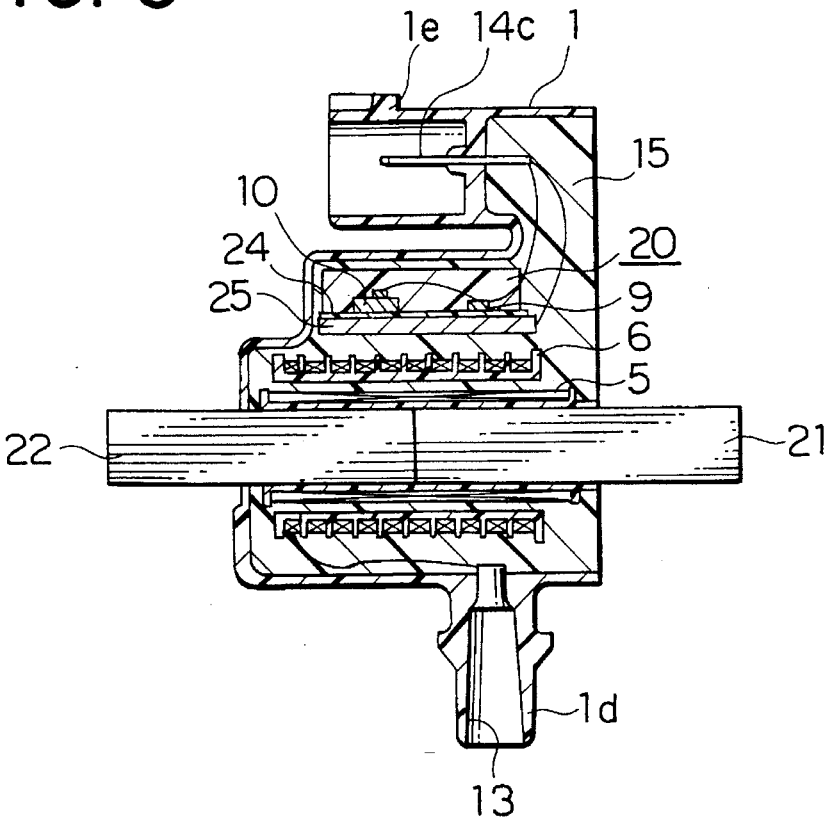
FIG. 3 is a sectional front view showing another embodiment of the ignition apparatus for an internal combustion engine according to the present invention.

FIG. 3 is a front sectional front view showing another embodiment of the ignition apparatus for an internal combustion engine according to the present invention, wherein an electrically conductive and thermally conductive heat sink 25 is attached to a power switch 20 through an electrical insulation sheet 24 as an insulating member. The aluminum flat-pate-shaped heat sink 25 is electrically connected to a ground terminal 14*c*.

In the ignition apparatus for an internal combustion engine, the power switch 20 is shielded from electromagnetic waves by the heat sink 25 and is not affected by electromagnetic waves generated at the secondary coil 6 as the high-tension unit and the high-tension terminal 13.

Further, since the heat sink 25 having high heat conductivity is attached to the power switch 20, the heat generated when the power switch 20 is driven is uniformly diffused to the overall heat sink 25 and discharged to the outside through an insulating resin material 15 and an insulation case 1.

Embodiment 3

Figure 4:
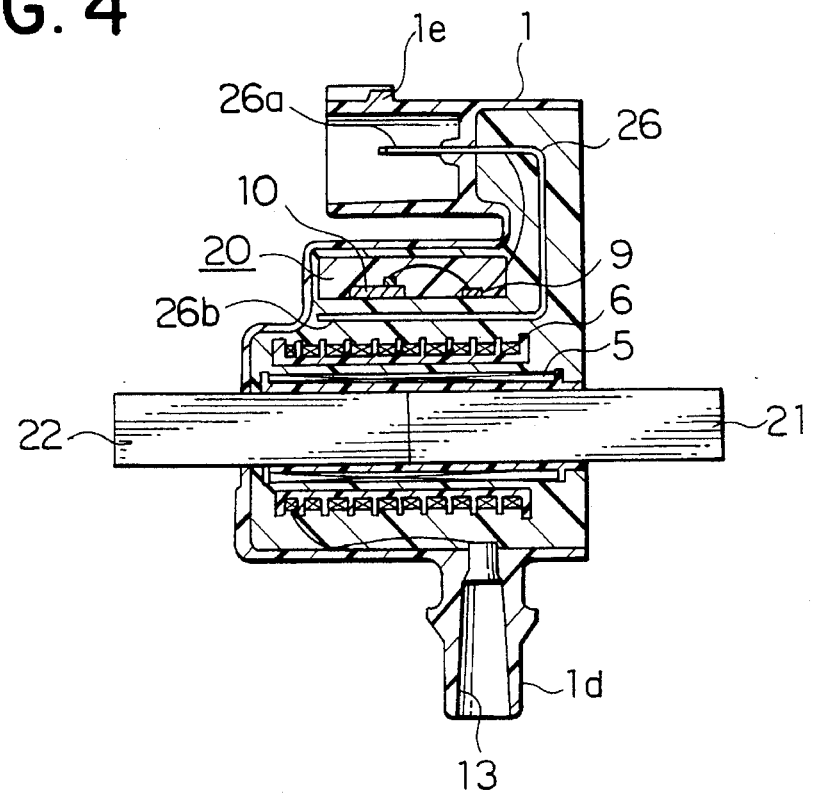
FIG. 4 is a sectional front view showing still another embodiment of the ignition apparatus for internal combustion engine according to the present invention.
Figure 5:
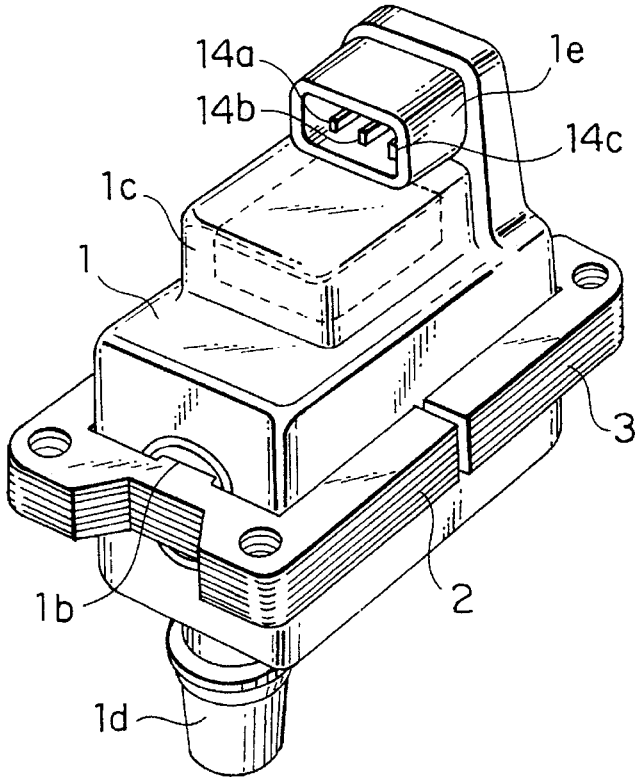
FIG. 5 PRIOR ART
FIG. 5 is an overall perspective view showing an example of conventional ignition apparatus for an internal combustion engine.
Figure 6:
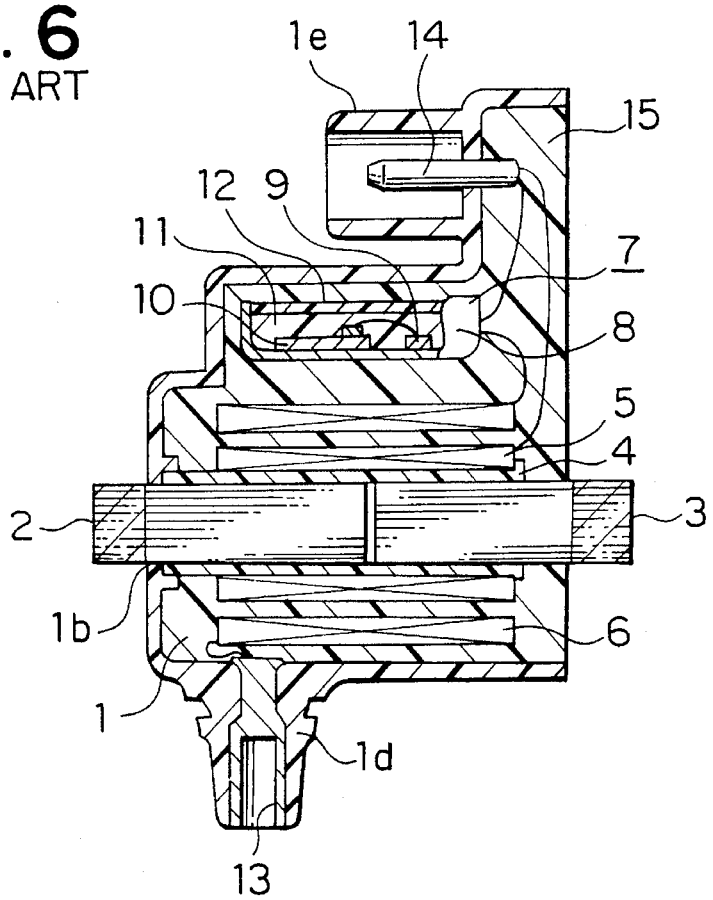
FIG. 6 PRIOR ART
FIG. 6 is a longitudinal sectional front view of the ignition apparatus shown in FIG. 5.
Figure 7:
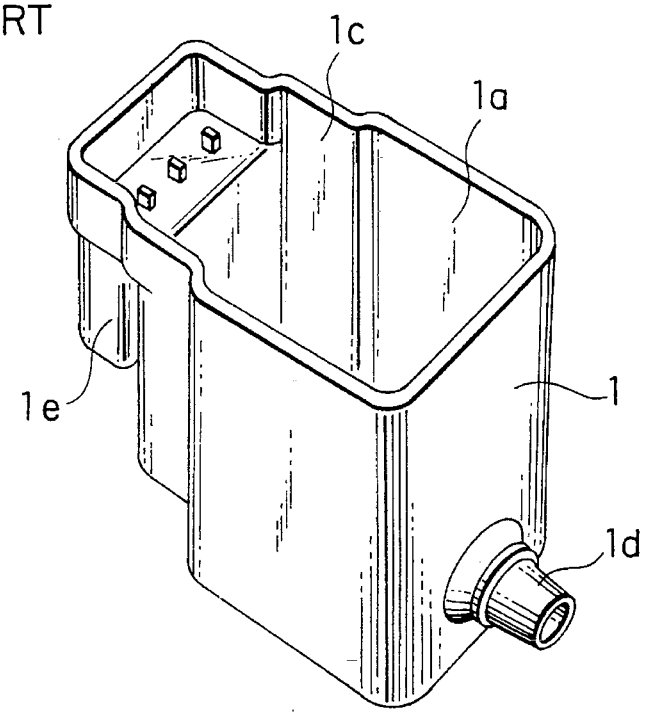
FIG. 7 PRIOR ART
FIG. 7 is a perspective view of the insulation case shown in FIG. 5.
Figure 8:
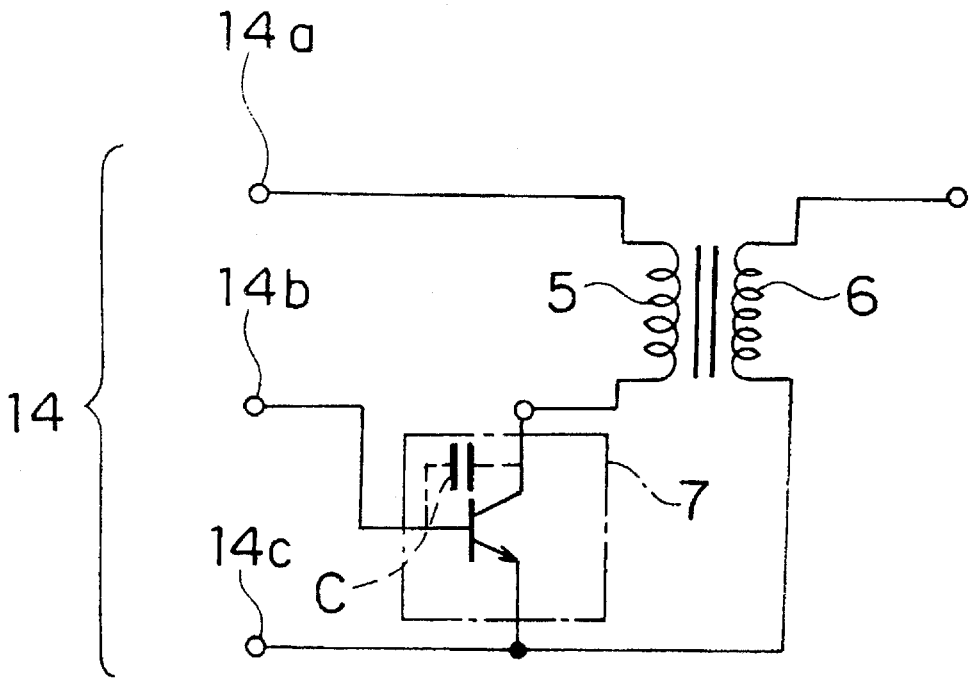
FIG. 8 PRIOR ART
FIG. 8 is an electric circuit diagram of the ignition apparatus for an internal combustion engine.

FIG. 4 is a sectional front view showing still another embodiment of the ignition apparatus for internal combustion engine according to the present invention, wherein a ground terminal 26 having a C-shaped cross section has an extreme end 26*a* exposed from a holding portion 1*e* for a low tension terminal unit and a base end portion 26*b* extending to a portion between a power switch 20 and a secondary coil 6. The base end portion 26*b* of the ground terminal 26 is formed into a flat plate.

In the ignition apparatus for internal combustion engine, electromagnetic waves generated at a secondary coil 6 as a high-tension unit and a high-tension terminal section 13 toward the power switch 20 is shielded by the base end portion 26*b* of the ground terminal 26 and do not affect the power switch 20.

Since the ground terminal 26 also acts as a shield, a member dedicated to a shield member is not needed.

As described above, according to the ignition apparatus for the internal combustion engine of the present invention, since the shield for shielding electromagnetic waves from the power switch is interposed between the ignition coil and the power switch, electromagnetic waves discharged toward the power switch from the ignition coil are shielded by the shield, so that the malfunction of the power switch and like caused by the effect of the electromagnetic waves can be prevented.

According to the ignition apparatus for the internal combustion engine of the present invention, since the shield plate is used as the shied, electromagnetic waves discharged toward the power switch from the ignition coil are shielded by the shield plate, so that the malfunction of the power switch and like caused by the effect of the electromagnetic waves can be prevented.

According to the ignition apparatus for the internal combustion engine of the present invention, since the heat sink as the shield is attached to the power switch through the electrically insulating member, the heat sink shields the power switch from the electromagnetic waves as well as can discharge heat generated at the power switch toward the outside air, so that a member dedicated to the shield member is not required, thus the number of parts need not be increased.

According to the ignition apparatus for internal combustion engine of the present invention, since the continuous, unitary structure extended from a ground terminal is used as the shield, the structure can shield the power switch from electromagnetic waves, so that a member dedicated to the shield member is not required, thus the number of parts need not be increased.

What is claimed is:

1. An ignition apparatus for an internal combustion engine comprising: an ignition coil; a power switch for supplying a primary current to said ignition coil; an electrically insulating caste containing said ignition coil and said power switch therein; an electromagnetic shield disposed between said ignition coil and said power switch for protecting said power switch from electromagnetic waves generated at the ignition coil; and an electrically insulating resin disposed within said case for securely holding said ignition coil, said power switch, and said shield within said case.

2. An ignition apparatus for an internal combustion engine according to claim 1, wherein said shield is composed of a shield plate.

3. An ignition apparatus for internal combustion engine according to claim 1, wherein said shield is composed of an electrically conductive heat sink attached to said power switch through an electrically insulating member.

4. An ignition apparatus for an internal combustion engine according to claim 1, wherein said shield is a continuous, unitary structure extended from a ground terminal.

* * * * *